US007008102B2

(12) United States Patent
Taillard et al.

(10) Patent No.: US 7,008,102 B2
(45) Date of Patent: Mar. 7, 2006

(54) MECHANICAL TIMEPIECE COMPRISING A TOURBILLON

(75) Inventors: Christian Taillard, Les Fins (FR); Laurent Besse, Villers-le-Lac (FR)

(73) Assignee: Zenith International S.A., Le Locle (CH)

( * ) Notice: Subject to any disclaimer, the term of this patent is extended or adjusted under 35 U.S.C. 154(b) by 0 days.

(21) Appl. No.: 10/513,444

(22) PCT Filed: Apr. 24, 2003

(86) PCT No.: PCT/CH03/00268

§ 371 (c)(1),
(2), (4) Date: Nov. 3, 2004

(87) PCT Pub. No.: WO03/093907

PCT Pub. Date: Nov. 13, 2003

(65) Prior Publication Data

US 2005/0243652 A1 Nov. 3, 2005

(30) Foreign Application Priority Data

May 2, 2002 (EP) ..... 02405357

(51) Int. Cl.
*G04B 1/10* (2006.01)
*G04B 15/00* (2006.01)

(52) U.S. Cl. ..... 368/127; 368/142

(58) Field of Classification Search ..... 368/124–127, 368/139–143, 168, 169
See application file for complete search history.

(56) References Cited

U.S. PATENT DOCUMENTS

| | | | | |
|---|---|---|---|---|
| 5,608,694 | A | 3/1997 | Grimm et al. | 368/127 |
| 6,402,368 | B1 | 6/2002 | Grimm et al. | 368/127 |
| 6,749,333 | B1 * | 6/2004 | Scheufele | 368/127 |
| 6,890,094 | B1 * | 5/2005 | Dias | 368/127 |

FOREIGN PATENT DOCUMENTS

| | | |
|---|---|---|
| EP | 0 681 227 A | 11/1995 |
| EP | 0 973 076 A | 1/2000 |

OTHER PUBLICATIONS

"Classe Evasion" AGEFI (Switzerland) 6; Mar. 2001.

* cited by examiner

*Primary Examiner*—Vit W. Miska
(74) *Attorney, Agent, or Firm*—Browning Bushman P.C.; Hugh R. Kress

(57) ABSTRACT

The invention relates to a timepiece consisting of a main plate (24) having the following components mounted thereto: a time base which is formed by a tourbillon (16) comprising a rotatable frame, which appears in an opening (14*a*) in the dial (14) thereof; and time information display means which are controlled from the time base. The aforementioned display means comprise a rotatable ring (40) which appears in the opening (14*a*) in the dial, co-axially around the frame, and ring drive means.

14 Claims, 4 Drawing Sheets

MECHANICAL TIMEPIECE COMPRISING A TOURBILLON

Figure 1:
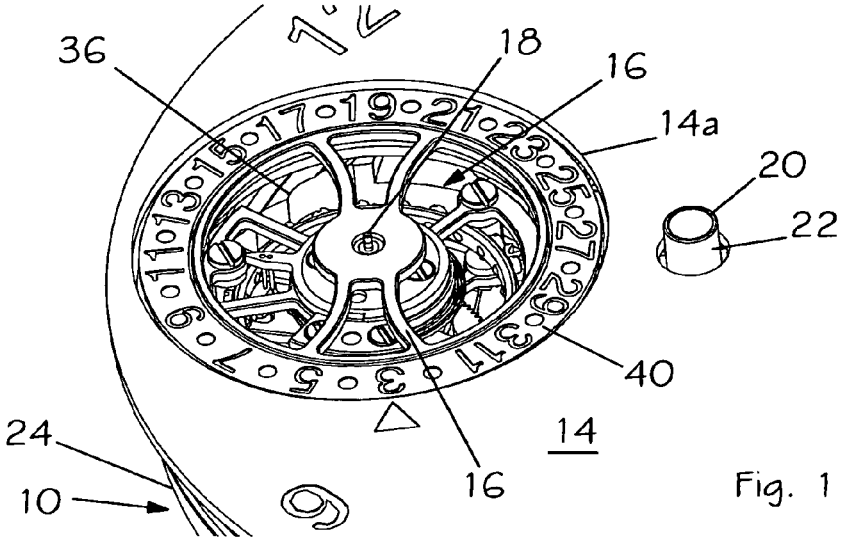

The present invention relates to a mechanical timepiece provided with a tourbillon.

It is known that, when the escapement of a mechanical watch is in the vertical position, the Earth's gravitation accelerates or, on the contrary, brakes the oscillation of its balance, causing it either to be fast or slow. In order to compensate for these deviations in the running rate, Abraham-Louis Breguet proposed, in 1801, an exceptional regulating member, the tourbillon with which high-quality watches are now equipped.

In a tourbillon, a movable frame is driven by the barrel, through the train, at a rate of one revolution per minute. At its center, this frame carries the sprung balance. The escape wheel is driven by a pinion off-centered with respect to the axis of the frame, and called the satellite pinion, which meshes with a fixed wheel. By rotating, the frame thus cancels out the deviations in the running rate of the watch.

Watchmakers have always sought to show the elegant and prestigious mechanism constituted by the tourbillon on the dial side, furnished at this location with an appropriate opening. This choice making the displaying of the date by a disk in an aperture difficult, the tourbillon-type watches proposed hitherto generally comprise a date display with the aid of a small hand which, from an aesthetic point of view, competes with the tourbillon, or then occupies room which could be assigned to the displaying of higher-quality functions (power reserve, equation of time, temperature, chronograph, etc). It is, moreover, difficult to read the date of the month when it is displayed by means of a hand, as is the case for the "automatic tourbillon with perpetual calendar" watch marketed by the firm Blancpain.

The Audemars Piguet company has developed a watch, called "Tourbillon Grande Date Jules Audemars", which is equipped with a date display in an aperture. The solution adopted involves display by means of two disks, one for the tens, the other for the units, this requiring considerable energy and occupying a large area of the dial, preventing the display of other information.

The two aforementioned watches are described, for example, in the magazine "Classe Evasion" No 6, March 2001, published by the AGEFI (Switzerland).

An aim of the present invention is to propose a timepiece with tourbillon which can provide an indication of the date, or of any other value desired by the maker, without occupying, on the dial, too much room impeding the tourbillon or taking the place of more prestigious functions.

More precisely, the invention relates to a timepiece of the type comprising a main plate and, mounted on the latter, a time base formed by a tourbillon comprising a rotatable frame which appears in an opening made in its dial, and time information display means controlled from the time base. This timepiece is mainly characterized in that said display means comprise a rotatable ring which appears in the opening of the dial around the frame of the tourbillon, coaxially with it, and members driving this ring.

The timepiece according to the invention also comprises the following main characteristics:

- the frame of the tourbillon is mounted rotatably between the main plate and an additional plate;
- this plate comprises cutouts through which the tourbillon appears;
- the display ring is mounted rotatably inside a groove made in the additional plate;

- this ring is associated with a toothed wheel which is concentric with it and co-operates with the driving means;
- this toothed wheel also co-operates with means of manual adjustment of the position of the display ring;
- the ring is held in place by at least one platelet fixed to the additional plate and protruding into its groove so as to fit between the ring and its toothed wheel; and
- the display ring is a date indicator.

Figure 2:
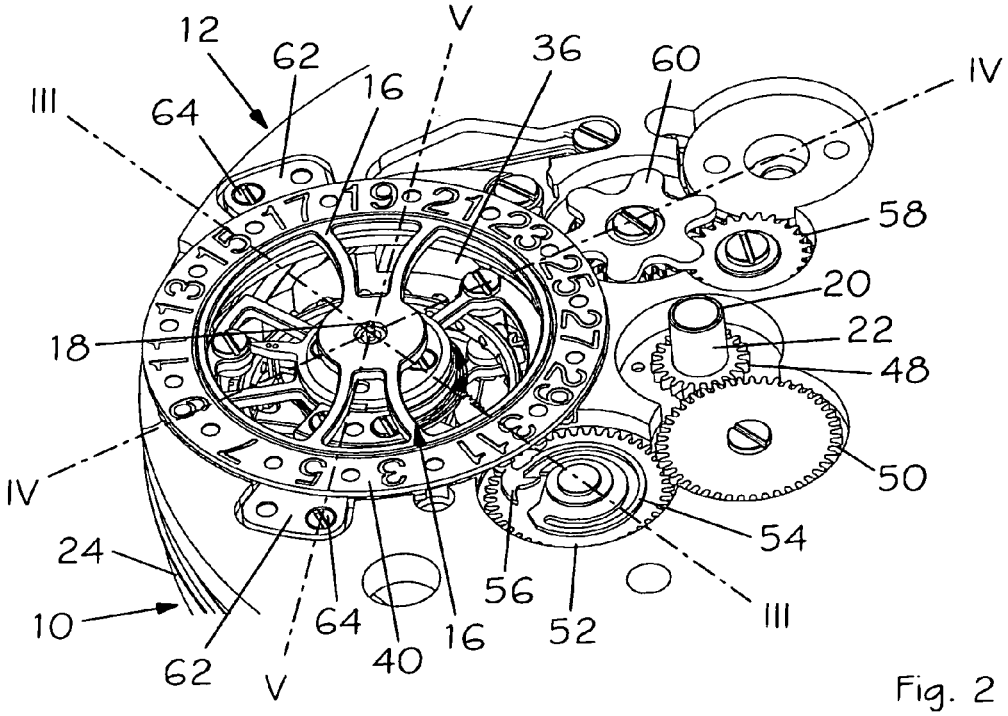
Figure 3:
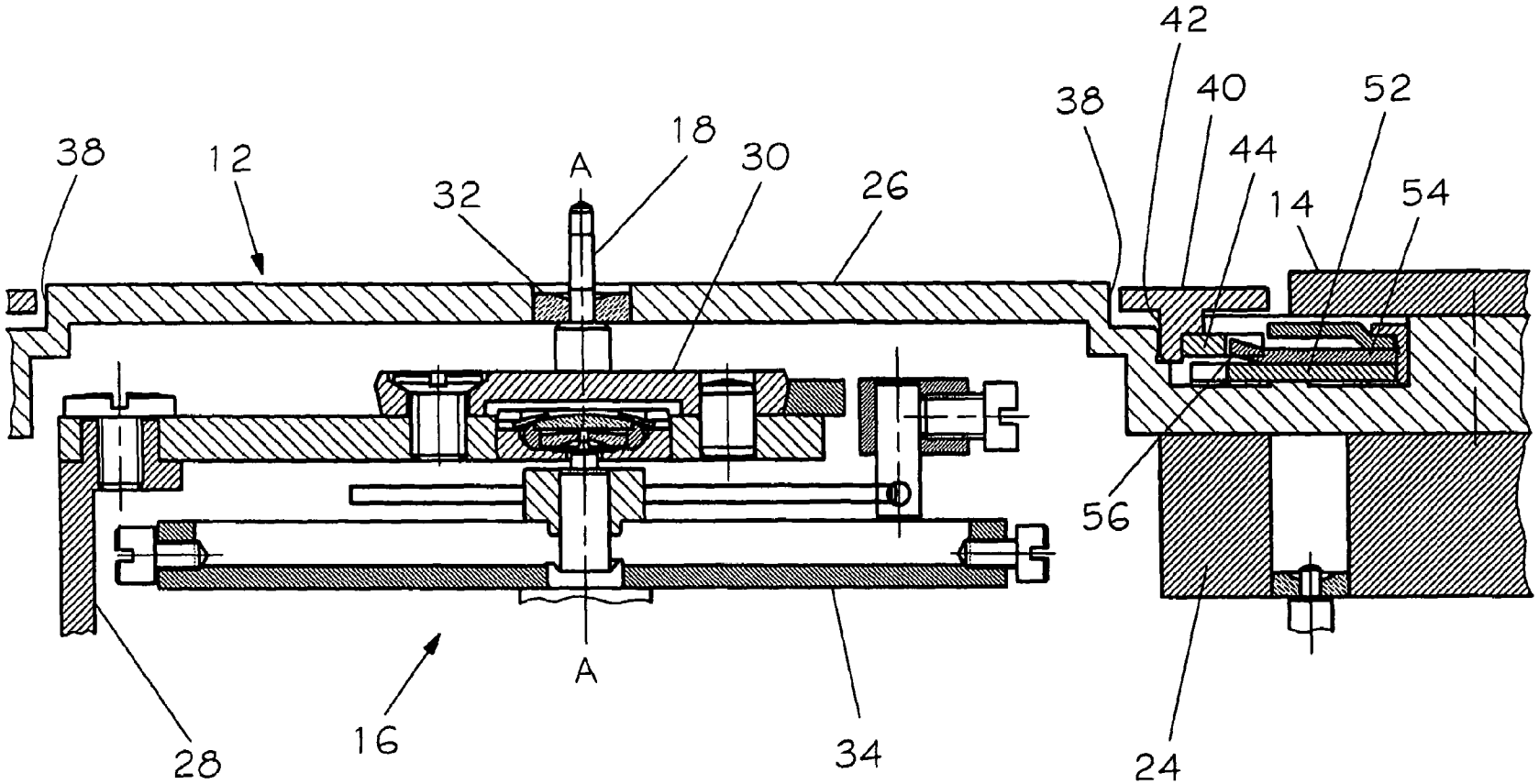
Figure 4:
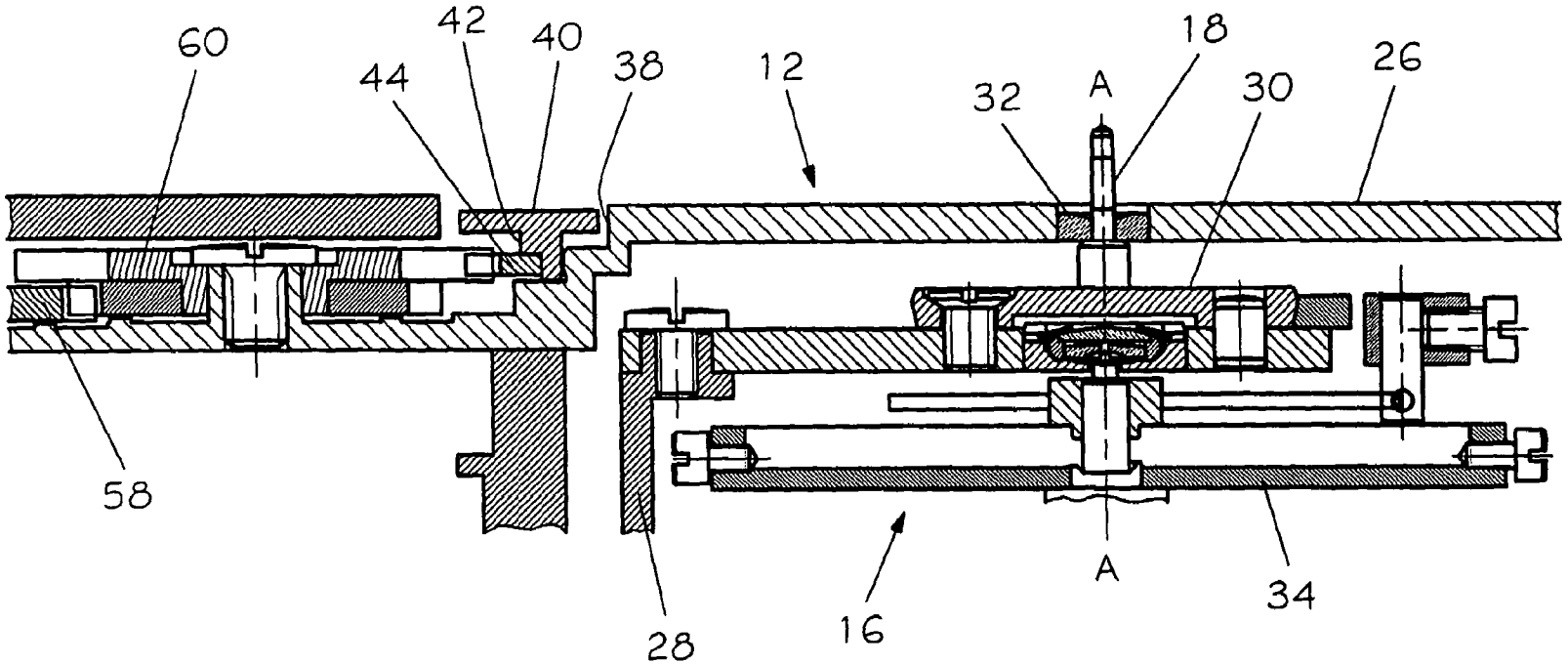
Figure 5:
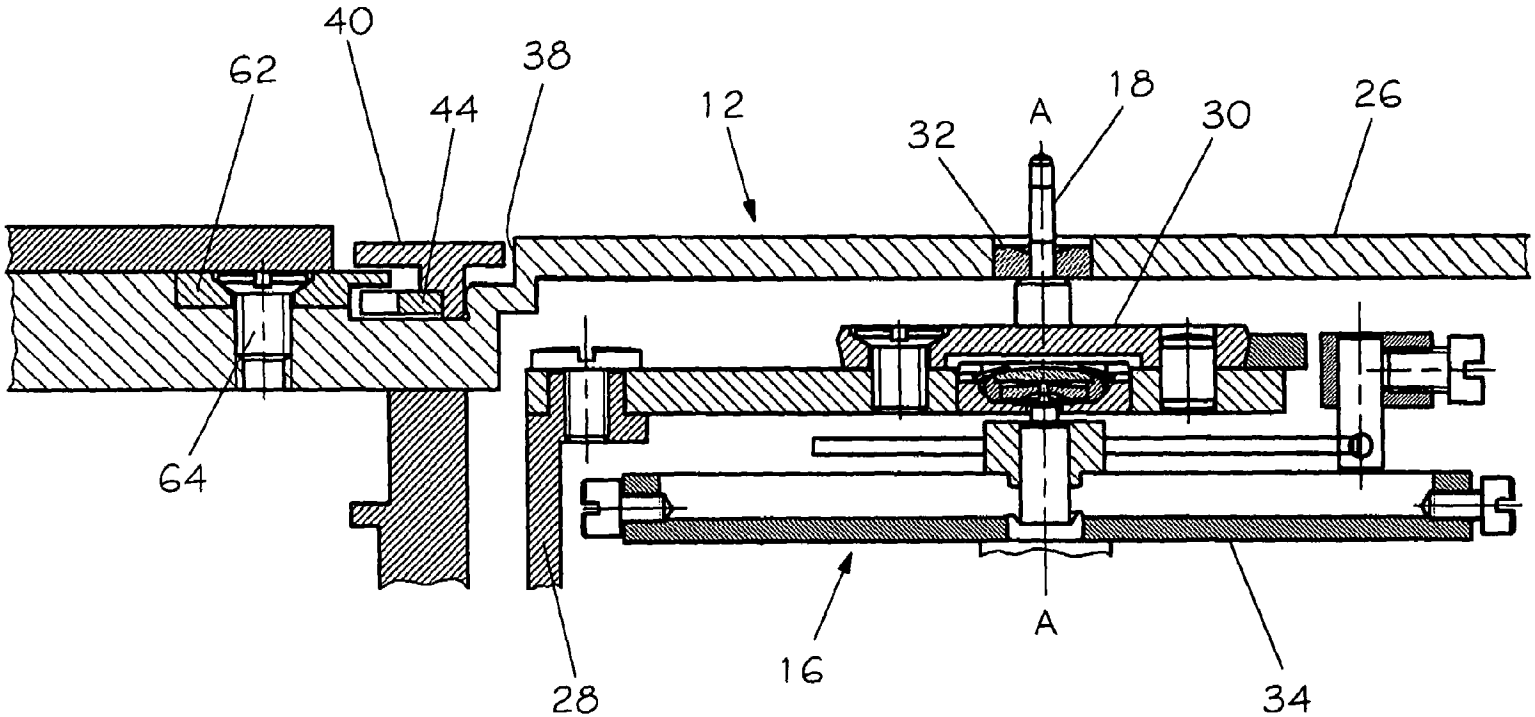

Other characteristics of the invention will emerge from the description which follows, given in conjunction with the appended drawing, in which:

FIGS. 1 and 2 represent, viewed from above in perspective, a part of the timepiece according to the invention, respectively with and without its dial; and FIGS. 3, 4 and 5 are sectional views, respectively along III—III, IV—IV and V—V, of a part of the movement intended to equip this timepiece.

The timepiece illustrated in FIGS. 1 and 2 is intended to display the hour, the minute, the second and the date. It comprises, for this purpose, a base movement 10 and an additional plate 12, fixed on the base movement 10 and intended to carry certain components, as will be explained in greater detail with reference to FIGS. 3 to 5. A dial 14, fixed on the base movement 10 and provided with a circular opening 14*a*, serves as reference for the display of the time information.

The running rate of this timepiece is regulated by a tourbillon 16, visible through the opening 14*a* and mounted pivotably on the base movement 10 and the plate 12. The tourbillon 16 comprises a pipe 18 intended to carry a seconds hand.

The hour and the minute are displayed, in a conventional manner, by means of hands that do not appear in the drawing, carried respectively by coaxial runners 20 and 22 disposed at the center of the movement 10.

The movement 10 comprises a framework, formed by a main plate 24 and by bridges that are not visible in the drawing. This framework serves as support to the movable elements of the movement 10, more particularly and in a conventional manner, to the barrel, to the finishing train and to the time setting mechanism.

If the watch is an automatic one, the framework may, furthermore, carry the automatic winding mechanism.

The additional plate 12 makes it possible to add mechanisms undertaking complementary functions, in this instance a date display. It exhibits a protuberance 26 sitting in the opening 14*a* of the dial. This plate is fixed and positioned on the main plate 14 by means that are not represented, for example feet and screws, and on which are disposed the members of the complementary mechanisms.

As shown in FIG. 3, the tourbillon 16 comprises a frame 28, mounted pivotably about an axis A—A, on the one hand, on a bridge integral with the main plate 24 and, on the other hand, on the plate 12.

On the dial side, the frame carries a seat 30 carrying the pipe 18. The protuberance 26 is drilled with a hole into which is hammered a jewel 32 serving as bearing for the pipe 18. In a conventional manner, a sprung balance 34 is mounted in the frame 28, pivoting about the same axis A—A.

The protuberance 26 of the additional plate 12 possesses, around the jewel 32, cutouts 36 (visible in FIGS. 1 and 2) making it possible to see the tourbillon 16. The plate 12 furthermore comprises an annular groove 38, with axis A—A, open on the dial side and serving as housing for a date ring 40 which bears the numerals 1 to 31. This ring 40 possesses, inwardly, an annulus 42 onto which is hammered a crown 44 with thity-one teeth appearing in the opening 14*a* of the dial.

As shown in FIGS. 2 and 3, a central wheel 48, driven at a rate of one revolution in twelve hours, meshes with an intermediate wheel 50 which itself meshes with a control wheel 52 associated with a spring 54 terminating in a drive pawl 56 co-operating with the crown 44. The wheels 50 and 52 make one revolution per day.

Thus, a date mechanism of conventional type is produced, by virtue of which, each day at midnight, the pawl 56, propelled by the spring 54 which is previously stretched, advances the crown 44 by one step and hence likewise the date ring 40 surrounding the tourbillon 16.

Reference will now be made, more particularly, to FIGS. 2 to 4 which show the way in which the ring 40 is set to the correct date. A wheel 58 is linked, in a conventional manner, with the train for manually setting the watch to time by means of a control stem. This wheel meshes with a runner 60, furnished with six leaves co-operating with the crown 44.

By virtue of this construction, turning the wheel 58 with the aid of the control stem allows the runner 60 to rotate the date ring 40 so as to set it into the position where it displays the date desired by the user.

Finally, reference will be made to FIGS. 2 and 5 in which appear, disposed substantially at 120° to one another, toward the outside of the timepiece, two platelets 62 fixed by a screw 64 onto the plate 12. Each platelet protrudes, via its end, into the groove 38 so as to fit between the date ring 40 and its crown 44, which it thus holds in place.

The present description has been given while referring to a tourbillon surrounded by a date-indicating ring. It goes without saying, however, that the invention is not limited to the displaying of the date and that the ring may serve as indicator for any other time information, the management of which is well understood by the maker.

Thus, proposed is a timepiece with tourbillon which can provide an indication of the date, or of any other value desired by the craftsman, without occupying, on the dial, too much room.

What is claimed is:

1. A timepiece comprising a main plate (24) and, mounted on the latter, a time base formed by a tourbillon (16) comprising a rotatable frame (28) which appears in an opening (14*a*) made in a dial of the timepiece (14), and time information display means controlled from said time base, characterized in that said means comprise a rotatable ring (40) which appears in said opening around said frame (28), coaxially with it, and elements driving this ring.

2. The timepiece as claimed in claim 1, characterized in that said frame (28) is mounted rotatably between said main plate (24) and an additional plate (12).

3. The timepiece as claimed in claim 2, characterized in that said plate (12) comprises cutouts (36) through which the tourbillon (16) appears.

4. The timepiece as claimed in claim 3, characterized in that said ring (40) is mounted rotatably inside a groove (38) made in said plate (12).

5. The timepiece as claimed in claim 4, characterized in that said ring (40) is associated with a toothed wheel (44) which is concentric with it and co-operates with said driving means.

6. The timepiece as claimed in claim 5, characterized in that said toothed wheel (44) also co-operates with means of manual adjustment of the position of said ring.

7. The timepiece as claimed in claim 5, characterized in that said ring (40) is held in place by at least one platelet (62) fixed to said plate (12) and protruding into said groove (38) so as to fit between said ring (40) and said toothed wheel (44).

8. The timepiece as claimed in claim 1, characterized in that said ring (40) is a date indicator.

9. The timepiece as claimed in claim 2, characterized in that said ring (40) is a date indicator.

10. The timepiece as claimed in claim 3, characterized in that said ring (40) is a date indicator.

11. The timepiece as claimed in claim 4, characterized in that said ring (40) is a date indicator.

12. The timepiece as claimed in claim 5, characterized in that said ring (40) is a date indicator.

13. The timepiece as claimed in claim 6, characterized in that said ring (40) is a date indicator.

14. The timepiece as claimed in claim 7, characterized in that said ring (40) is a date indicator.

* * * * *